US007766147B2

(12) United States Patent
Nishida et al.

(10) Patent No.: US 7,766,147 B2
(45) Date of Patent: Aug. 3, 2010

(54) COUNTERFEIT MONEY DISCRIMINATION SUPPORT DEVICE

(75) Inventors: Koichi Nishida, Ota-Ku (JP); Kazuyuki Shimuzu, Yashio (JP)

(73) Assignee: Glory Ltd., Himeji-Shi (JP)

( * ) Notice: Subject to any disclaimer, the term of this patent is extended or adjusted under 35 U.S.C. 154(b) by 370 days.

(21) Appl. No.: 11/993,538

(22) PCT Filed: Jun. 7, 2006

(86) PCT No.: PCT/JP2006/311440

§ 371 (c)(1),
(2), (4) Date: Dec. 21, 2007

(87) PCT Pub. No.: WO2007/000883

PCT Pub. Date: Jan. 4, 2007

(65) Prior Publication Data

US 2009/0107800 A1 Apr. 30, 2009

(30) Foreign Application Priority Data

Jun. 27, 2005 (JP) ..... 2005-186074

(51) Int. Cl.
*G07D 7/00* (2006.01)

(52) U.S. Cl. ..... 194/302

(58) Field of Classification Search ..... 194/302, 194/205

See application file for complete search history.

(56) References Cited

U.S. PATENT DOCUMENTS

2003/0182217 A1 9/2003 Chiles

FOREIGN PATENT DOCUMENTS

| | | |
|---|---|---|
| JP | 2000-251106 | 9/2000 |
| JP | 2004-240607 | 8/2004 |
| WO | 96/10800 A1 | 4/1996 |
| WO | WO 96/10800 A1 * | 4/1996 |

* cited by examiner

*Primary Examiner*—Patrick Mackey
*Assistant Examiner*—Mark Beauchaine
(74) *Attorney, Agent, or Firm*—Burr & Brown

(57) ABSTRACT

The counterfeit money discrimination support device is configured to eject only the banknotes of the same denomination as a predetermined denomination of money, as specific banknotes, among banknotes taken into the device from the exterior. The denomination and quantity of the specific banknotes ejected to the exterior are stored in a memory 23. Thereafter, the specific banknotes discriminated as being not counterfeit banknotes, by hand, are then taken again into the device. When the denomination and quantity of the specific banknotes taken again into the device respectively correspond to the denomination and quantity stored in the memory 23, the discriminating operation for the counterfeit banknotes is judged to have been properly completed.

6 Claims, 2 Drawing Sheets

COUNTERFEIT MONEY DISCRIMINATION SUPPORT DEVICE

FIELD OF THE INVENTION

The present invention relates to a counterfeit money discrimination support device for supporting a discriminating operation for discriminating, by hand, whether money is counterfeit money or not.

BACKGROUND ART

In the past, as a money automatic deposit device adapted to classify and take out money of a specific denomination among those, which are collectively deposited into the device and include various denominations of money, a device as disclosed in, for example, JP59-177691A, has been known. As used herein, the money refers to banknotes and coins. In such a money automatic deposit device, there is a possibility that counterfeit money may be included in the money to be collectively deposited therein. Thus, there is a need for discriminating, separately, whether or not the counterfeit money is included in the money to be deposited. In particular, for the dollar banknotes and euro banknotes, for example, the possibility that they may include the counterfeit money is higher than the other banknotes. Therefore, the necessity, for discriminating whether the counterfeit money is included or not, has been higher in the United States and European countries, for example.

One method, for discriminating whether the counterfeit money is included or not, is to perform a discriminating operation for checking whether the counterfeit money is included or not, by hand, such as by visual check and/or hand feeling of an operator, for all of the money including various denominations of money. Another known method employs an automatic discriminating device adapted to automatically discriminate whether money is the counterfeit money or not (see JP2002-279477A and JP10-247262A, etc.).

However, in the method in which an operator performs the discriminating operation for checking whether the counterfeit money is included or not, by hand, for all of the money, a significantly great burden should be imposed on the operator if the quantity of the money collectively deposited is very large. In addition, such discriminating operation should take a very long time.

On the other hand, in the method of employing the automatic discriminating device adapted to automatically discriminate whether money is the counterfeit money or not, such a device is generally quite expensive because it should be comprised of a significantly high-precision machine, thus disadvantageously increasing the total cost of the money automatic deposit device itself. Furthermore, the automatic discriminating device is configured to automatically take an image of money to be checked and then compare the so-taken image of the money with money as a standard, so as to provide a rapid and reliable discrimination for checking the counterfeit money. However, it should be appreciated that, in the case where the operator performs the discrimination for checking the counterfeit money by directly touching money, there should be an advantage that the operator can recognize, more securely, by a tactile sense, such as by hand feeling, that there is counterfeit money included in the money to be checked. Namely, for discriminating the counterfeit money from all of the money based on the quality of paper used for the money, it is generally known that there are often the cases in which judgment due to the tactile sense of a human is more accurate and/or superior as compared with judgment due to a machine.

SUMMARY OF THE INVENTION

The present invention was made in view of the above, and therefore it is an object of this invention to provide a counterfeit money discrimination support device which can save the labor of an operator and reduce the time required for a series of steps for a discriminating operation, as compared with the case in which the operator performs the discriminating operation for checking whether money is the counterfeit money or not, by hand, for all of the money, and can reduce the cost for the entire device, as compared with the case of employing the automatic discriminating device adapted to automatically discriminate whether the money is the counterfeit money or not, and enables the operator to recognize, by a tactile sense, such as by hand feeling, that there is counterfeit money included in the money to be checked.

The counterfeit money discrimination support device according to the present invention is a counterfeit money discrimination support device for supporting a discriminating operation, by hand, for checking whether money is counterfeit money or not, the counterfeit money discrimination support device comprising: a denomination setting unit for setting, in advance, a denomination of money to be discriminated, as a predetermined denomination of money; a money taking-in unit for taking money into the device from the exterior; a denomination judging unit for judging whether or not the denomination of the money taken into the device by the money taking-in unit is identical to the predetermined denomination of money set in advance by the denomination setting unit; a money ejecting unit for ejecting the money judged to be of the denomination identical to the predetermined denomination of money by the denomination judging unit, to the exterior, as specific money; and a memory for storing, therein, the denomination and quantity of the specific money ejected by the money ejecting unit, wherein the specific money discriminated as being not counterfeit money, by hand, among the specific money to be ejected to the exterior by the money ejecting unit is taken again into the device by the money taking-in unit, and wherein when the denomination and quantity of the specific money taken again into the device correspond respectively to the denomination and quantity of money stored in the memory, the discriminating operation for the counterfeit money is judged to have been properly completed. As used herein, the money refers to banknotes and/or coins.

With this counterfeit money discrimination support device, since the banknotes of a specific denomination, such as large banknotes, can be automatically selected and a discriminating operation can be performed for only the so-selected banknotes, the labor of the operator can be saved and the time required for a series of steps for the discriminating operation can be reduced, significantly, as compared with the case in which the operator must perform the discriminating operation, by hand, for all of the banknotes, for checking whether or not the banknotes are counterfeit ones. Additionally, the counterfeit money discrimination support device can reduce the cost to be required for the entire device, as compared with the case of employing an automatic discriminating device, which is adapted to automatically discriminate whether or not the banknotes are counterfeit ones. Furthermore, with the counterfeit money discrimination support device of this invention, the operator can recognize, due to a tactile sense, such-as by hand feeling, that there is counterfeit money included in the money to be checked, by directly touching the banknotes.

Preferably, the counterfeit money discrimination support device of this invention further comprises an end of discriminating operation annunciating unit for informing the operator that the discriminating operation for the counterfeit money was properly completed, when the discriminating operation for the counterfeit money is judged to have been properly completed.

With this counterfeit money discrimination support device, the operator can securely recognize that the discrimination operation for the counterfeit money has been properly completed.

Preferably, the counterfeit money discrimination support device of this invention is connected with an external point-of-sale system, and further comprises a transmitting unit for transmitting information that the discriminating operation for the counterfeit money was properly completed, to the point-of-sale system, when the discriminating operation for the counterfeit operation is judged to have been properly completed.

With this counterfeit money discrimination support device, the information that the discriminating operation for the counterfeit money has been properly ended can be securely transmitted to the external point-of-sale system, thereby to perform a desired information management in the point-of-sale system.

In the counterfeit money discrimination support device of this invention, it is preferred that the transmitting unit also transmits information related to the denomination and quantity of money taken first into the device from the exterior by the money taking-in unit, to the point-of-sale system, when the discriminating operation for the counterfeit money is judged to have been properly completed.

With this counterfeit money discrimination support device, secure control due to the point-of-sale system for the information related to the denominations and quantities over all of the money to be taken into the counterfeit money discrimination support device can be ensured.

Preferably, the counterfeit money discrimination support device of this invention further comprises an alerting unit for notifying the operator that there is a need for performing the discriminating operation, by hand, when the denomination judging unit judges that the money to be taken into the device by the money taking-in unit include money of the denomination identical to the predetermined denomination of money.

With this counterfeit money discrimination support device, the operator can securely perform the discriminating operation due to the alerting unit, which is adapted to notify the operator when there is a need for performing the discriminating operation, by hand, after the money has been taken into the device by the money taking-in unit.

Preferably, the counterfeit money discrimination support device of this invention further comprises an alarming unit for alarming the operator when some trouble occurs in the counterfeit money discrimination support device, wherein the alerting unit and the alarming unit are respectively configured to transmit individual information to the operator by ways different from each other.

With this counterfeit money discrimination support device, the operator can securely recognize that some failure has occurred in the counterfeit money discrimination support device itself. Besides, the operator can securely distinguish the information to be provided for annunciating that there is a need for discriminating, by hand, for checking whether the banknote is a counterfeit one or not, from the information to be provided for notifying that some failure has occurred in the counterfeit money discrimination support device itself.

DETAILED DESCRIPTION OF THE INVENTION

Figure 1:
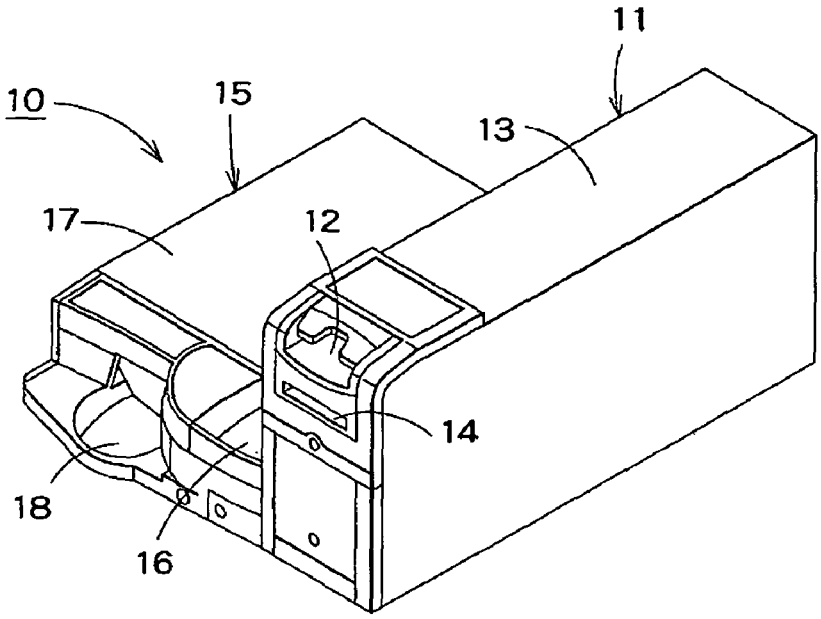
FIG. 1 is a perspective view showing an external appearance of a counterfeit money discrimination support device according to one embodiment of this invention.
Figure 2:
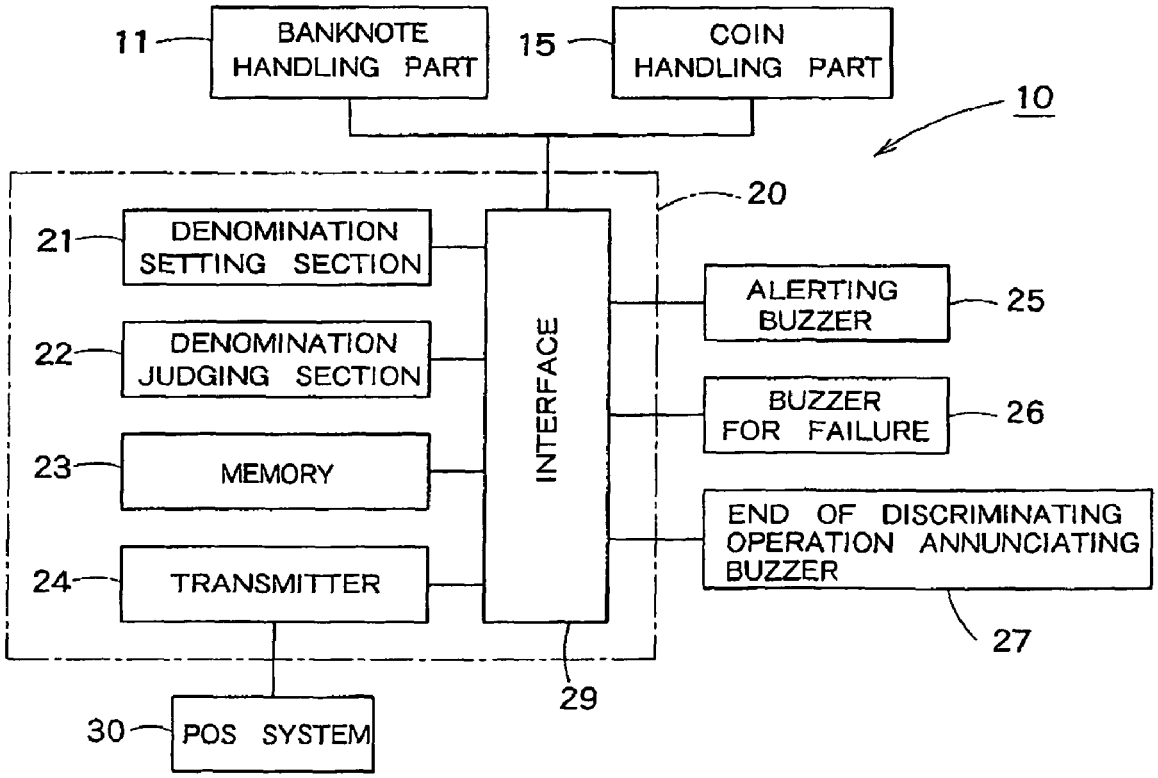
FIG. 2 is a block diagram showing a construction including a control unit and respective buzzers of the counterfeit money discrimination support device shown in FIG. 1.
Figure 3:
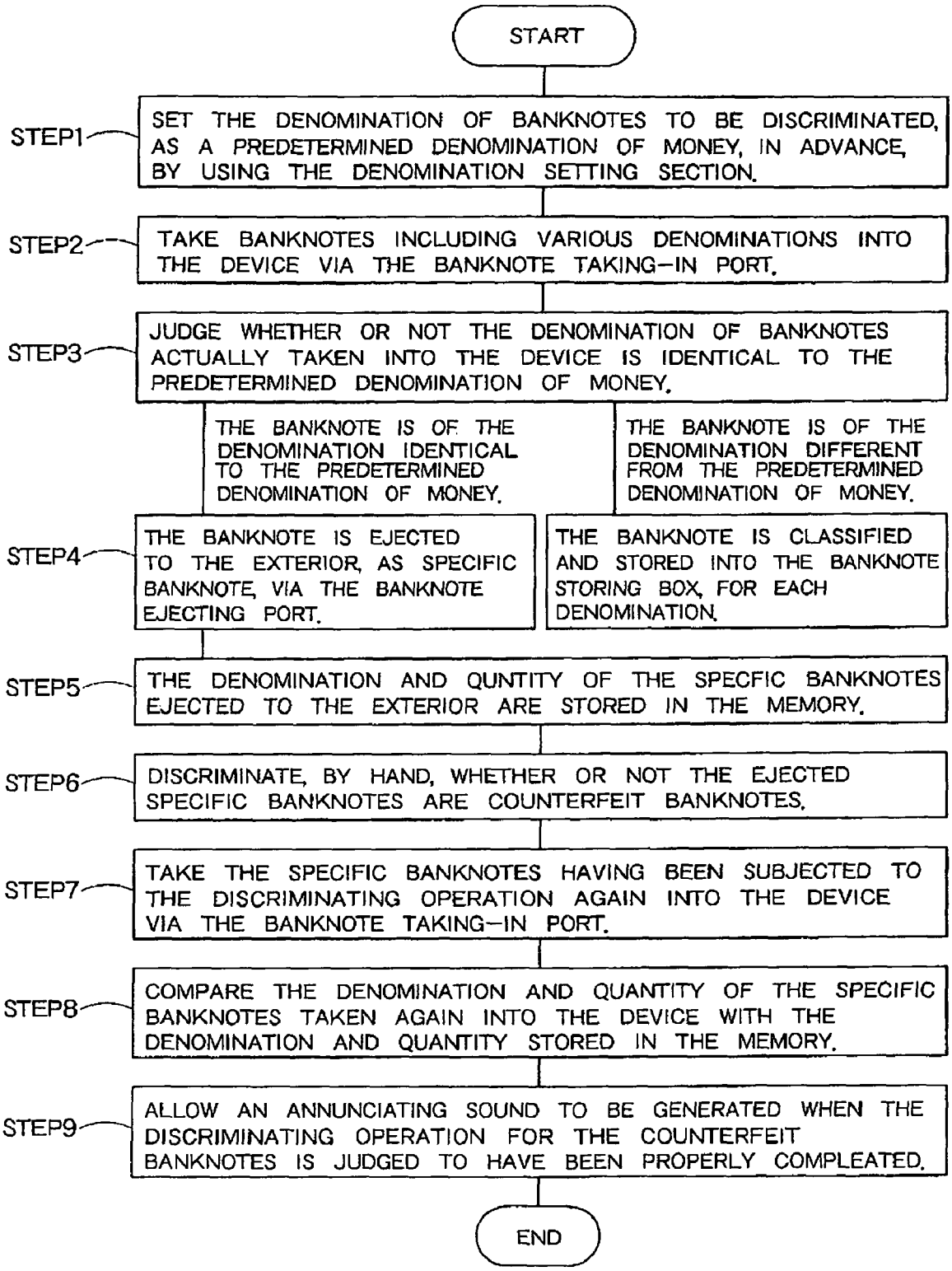
FIG. 3 is a flowchart showing respective steps upon performing a discriminating operation, by hand, for counterfeit money, by using the counterfeit money discrimination support device shown in FIG. 1.

Hereinafter, one embodiment of the present invention will be described with reference to the drawings. FIGS. 1 to 3 are illustrations for respectively explaining the counterfeit money discrimination support device according to the embodiment.

Among the drawings, FIG. 1 is a perspective view showing an external appearance of the counterfeit money discrimination support device according to the embodiment of this invention, FIG. 2 is a block diagram showing a construction including a control unit and respective buzzers of the counterfeit money discrimination support device shown in FIG. 1, and FIG. 3 is a flowchart showing respective steps upon performing a discriminating operation, by hand, for counterfeit money, by using the counterfeit money discrimination support device shown in FIG. 1.

The counterfeit money discrimination support device 10 according to this embodiment is for use in supporting a discriminating operation in which an operator discriminates whether money is counterfeit money or not, by hand, such as by visual check and/or hand feeling. As used herein, the money refers to banknotes and coins. Specifically, the counterfeit money discrimination support device 10 is configured to support a series of steps for the discriminating operation, wherein only the money of a denomination to be discriminated, such as large banknotes, among those taken into the counterfeit money discrimination support device 10, is ejected to the exterior, and then the operator performs a discriminating operation for checking, by hand, whether the ejected money includes counterfeit money or not, and returns the checked money again into the counterfeit money discrimination support device 10. The counterfeit money discrimination support device 10 constructed as described above is connected with an external point-of-sale system 30 (hereinafter, also referred to as a POS system).

As shown in FIG. 1, the counterfeit money discrimination support device 10 includes a banknote handling part 11 for handling banknotes and a coin handling part 15 for handling coins, while these two parts 11, 15 are laterally connected with each other. The banknote handling part 11 includes a banknote taking-in port 12 for taking banknotes into the device, a banknote storing box 13 for classifying the banknotes to be taken into the device through the banknote taking-in port 12, into each denomination, and then storing them therein, and a banknote ejecting port 14 for ejecting the banknotes present in the device to the exterior. The coin handling part 15 includes a coin taking-in port 16 for taking coins into the device, a coin storing box 17 for classifying the coins to be taken into the device through the coin taking-in port 16, into each denomination, and then storing them therein, and a coin ejecting port 18 for ejecting the coins present in the device to the exterior. In addition, as shown in FIG. 2, the counterfeit money discrimination support device 10 comprises a control unit 20 and respective buzzers 25, 26, 27, therein.

Hereinafter, a case in which the banknotes to be deposited into the counterfeit money discrimination support device 10 are dollar banknotes will be described.

The control unit 20, as shown in FIG. 2, includes a denomination setting section 21 for setting a denomination of banknotes to be discriminated, in advance, as a predetermined denomination of money, a denomination judging section 22 for judging whether or not the denomination of banknotes to be taken into the device is identical to the aforementioned predetermined denomination of money, and a memory 23 for storing or memorizing the denomination and quantity of banknotes to be ejected to the exterior. The denomination setting section 21, denomination judging section 22 and memory 23 are respectively connected with an interface 29, and the interface 29 is in turn connected with the banknote taking-in port 12, banknote storing box 13 and banknote ejecting port 14, of the banknote handling part 11, respectively. In addition, a transmitter 24 for receiving and transmitting information is connected with the interface 29, and the transmitter 24 is connected with an external POS system 30. Furthermore, an alerting buzzer 25, a buzzer 26 for failure, and an end of discriminating operation annunciating buzzer 27, which will be detailed below, are connected with the interface 29, respectively.

Now, each component of the counterfeit money discrimination support device 10 shown in FIGS. 1 and 2 will be described in more detail.

The denomination setting section 21 is one for setting, in advance, a denomination of a banknote to be discriminated whether it is counterfeit money or not, as a predetermined denomination of money. Specifically, by directly inputting the denomination of the banknote to be discriminated, via an operator, into the counterfeit money discrimination support device 10, or by sending the information stored in the POS system 30 to the money setting section 21, via the transmitter 24, the money setting section 21 can set, in advance, the predetermined denomination of money to be discriminated, based on the information inputted thereto.

The denomination judging section 22 is one for judging whether or not the denomination of banknotes taken into the device through the banknote taking-in port 12 is identical to the predetermined denomination of money, which was set in advance. In the vicinity of the banknote taking-in port 12, a detection sensor (not shown) for detecting the denomination of banknotes taken into the device from the exterior is provided. Thus, information related to the denomination of banknotes to be detected by the detection sensor can be sent to the denomination judging section 22. Thereafter, the denomination judging section 22 compares the predetermined denomination of money, which was set in advance by the denomination setting section 21, with the denomination of banknotes sent from the detection sensor. If both of the denominations of money are identical to each other, a control for ejecting the banknotes taken into the device to the exterior through the banknote ejecting port 14 will be performed by the control unit 20. The banknotes ejected in this manner will be referred to as "specific banknotes" below. If both of the denominations are different from each other, a control for classifying the banknotes taken into the device, into each denomination of money, and then storing them into the banknote storing box 13 will be performed by the control unit 20.

The memory 23 is one for storing or memorizing the denomination and quantity of the specific banknotes to be ejected to the exterior through the banknote ejecting port 14. Specifically, in the vicinity of the banknote ejecting port 14, a detection sensor (not shown) for detecting the denomination of the specific banknotes to be ejected to the exterior is provided. As such, information related to the denomination of the specific banknotes detected by the detection sensor and the number of the specific banknotes of the detected denomination, which have passed through the banknote ejecting port 14, is sent to the memory 23.

The transmitter 24, as shown in FIG. 2, is connected with the POS system 30, and configured to receive information stored in the POS system 30 and transmit information concerning the counterfeit money discrimination support device 10 to the POS system 30.

The alerting buzzer 25 is one for generating an alerting sound when the denomination judging section 22 judges that the banknotes taken into the device 10 via the banknote taking-in port 12 include some banknotes of the denomination identical to the predetermined denomination of money. If the operator listens the alerting sound generated from the alerting buzzer 25, the operator can recognize that there is a need for performing a discriminating operation, by hand, for checking whether the specific banknotes ejected from the banknote ejecting port 14 include counterfeit ones or not. On the other hand, if the alerting sound is not generated from the alerting buzzer 25, the operator can recognize that the banknotes to be discriminated whether they are counterfeit ones or not were not included in the banknotes taken into the device 10 through the banknote taking-in port 12.

The buzzer 26 for failure is one for generating an alarming sound when some failure, such as a paper jam, occurs at the banknote taking-in port 12, banknote storing box 13 and/or banknote ejecting port 14. Preferably, the alerting sound to be generated from the alerting buzzer 25 and the alarming sound to be generated from the buzzer 26 for failure are different from each other, such that the operator can distinguish one from the other. Therefore, when some sound is generated from the counterfeit money discrimination support device 10, the operator can securely distinguish the sound for annunciating that there is a need for performing the discriminating operation, by hand, for checking whether the banknotes are counterfeit ones or not, from the sound for notifying that some failure has occurred in the counterfeit money discrimination support device 10.

The end of discriminating operation annunciating buzzer 27 is one for informing the operator that the discriminating operation for the counterfeit banknote was ended, by generating an annunciating sound, when the discriminating operation for the counterfeit banknote is judged to have been properly ended.

Next, the operation of the embodiment constructed as described above will be discussed with reference to FIG. 3.

First, as shown in STEP 1 of FIG. 3, an operator inputs a denomination of banknotes to be discriminated, in advance, for checking whether or not they include counterfeit banknotes, into the denomination setting section 21, as a predetermined denomination of money. The predetermined denomination of money may be a single denomination or two or more denominations. As the denomination of banknotes to be discriminated, in advance, for checking whether or not they include counterfeit ones, for example, large banknotes or denominations of banknotes, which have been frequently counterfeited, are often inputted as the predetermined denomination of money. The information set in the denomination setting section 21 is then sent to the denomination judging section 22. One typical example, in which the denomination of 100-dollar banknotes, which have been frequently counterfeited among the dollar banknotes, is inputted to the denomination setting section 21, as the predetermined denomination of money, by the operator, will be discussed below.

Thereafter, as shown in STEP 2, the operator feeds or deposits banknotes including various denominations of money into the counterfeit money discrimination support device 10 via the banknote taking-in port 12. At this time, with the detection sensor provided in the vicinity of the banknote taking-in port 12, the denominations of banknotes taken into the device are detected, and the so-detected information related to the denominations is then sent to the denomination judging section 22.

Upon feeding or depositing the banknotes into the device 10, as shown in STEP 3, whether or not the denominations of the banknotes taken into the device 10 via the banknote taking-in port 12 are identical to the predetermined denomination of money set in advance by the denomination setting section 21 is judged, for each banknote, by the denomination judging section 22. Specifically, if the denominations and quantity of the banknotes taken into the device 10 via the banknote taking-in port 12 are one 100-dollar banknote and two 20-dollar banknotes, the denomination judging section 22 will judge that the one 100-dollar banknote corresponds to the predetermined denomination of money, while each of the two 20-dollar banknotes does not correspond to the predetermined denomination of money.

When the denomination judging section 22 judges that the banknotes taken into the device 10 via the banknote taking-in port 12 include ones having the denomination identical to the predetermined denomination of money, and more specifically, when the denomination judging section 22 judges that 100-dollar banknote is taken into the device 10 via the banknote taking-in port 12, the alerting buzzer 25 generates the alerting sound so as to notify the operator that there is a need for performing, by hand, the discriminating operation for the banknotes.

Subsequently, as shown in STEP 4, the banknotes judged to be of the denomination identical to the predetermined denomination of money, by the denomination judging section 22, are ejected to the exterior, as the specific money, via the banknote ejecting port 14. On the other hand, the banknotes judged to be of the denominations other than the predetermined denomination of money are classified into each denomination and then stored in the banknote storing box 13. Specifically, the 100-dollar banknote is ejected to the exterior as the specific money because it corresponds to the predetermined denomination of money, while the two 20-dollar banknotes are stored in a space (not shown) corresponding to the 20-dollar banknotes in the banknote storing box 13 because they do not correspond to the predetermined denomination of money, respectively.

Upon the ejecting operation of such specific banknotes, as shown in STEP 5, with the detection sensor provided in the vicinity of the banknote ejecting port 14, the denomination of the specific banknotes ejected to the exterior via the banknote ejecting port 14 is detected for each banknote, and the information related to the so-detected denomination of money and the quantity of the specific banknotes corresponding to the detected denomination is then transmitted to the memory 23 of the control unit 20. In this way, the memory 23 stores or memorizes the so-transmitted denomination and quantity of the specific banknotes. More specifically, the memory 23 memorizes that the one 100-dollar banknote corresponds to the specific banknote.

Next, as shown in STEP 6, the operator discriminates whether or not the specific banknote is counterfeit banknote, by hand, i.e., by observing and/or directly touching the specific banknote ejected from the banknote ejecting port 14. Generally, in regard to comparison between the quality of paper of the specific banknote ejected from the banknote ejecting port 14 and that of genuine ones, judgment by means of tactile sense of a human is often superior to judgment by means of a machine. If the specific banknote is proved to be a counterfeit one, the operator will perform a predetermined procedure, such as notifying the police, in response to the extraordinary case. If the specific banknote is judged not to include a counterfeit one, as shown in STEP 7, the operator deposits the specific money, after it is subjected to the discriminating operation again, into the counterfeit money discrimination support device 10 via the banknote taking-in port 12. More specifically, the operator performs the discriminating operation for checking whether or not the one 100-dollar banknote ejected from the banknote ejecting port 14 is a counterfeit banknote, as described above, and if judging it not to be a counterfeit one, the operator deposits the one 100-dollar banknote again into the counterfeit money discrimination support device 10 via the banknote taking-in port 12.

At that time, as shown in STEP 8, the denomination of the specific banknote taken into the device 10 via the banknote taking-in port 12 is detected by the detection sensor provided in the vicinity of the banknote taking-in port 12, and the information related to the so-detected denomination of money and the quantity of the specific banknote corresponding to the detected denomination (for example, the information that the specific banknote taken again into the device is one 100-dollar banknote) is then transmitted to the control unit 20. Finally, when the denomination and quantity of the specific banknote taken again into the device 10 correspond to the denomination and quantity both memorized in the memory 23, respectively, the control unit 20 judges that the discriminating operation of the counterfeit banknote was properly completed.

The specific banknote taken into the counterfeit money discrimination support device 10 via the banknote taking-in port 12 is then stored in the storing space corresponding to the denomination of the specific banknote in the banknote storing box 13, i.e., the storing space for 100-dollar banknotes.

Finally, as shown in STEP 9, when the control unit 20 judges that the discriminating operation for the counterfeit banknotes was properly completed, the end of discriminating operation annunciating buzzer 27 generates the annunciating sound. Thus, the operator can securely recognize that the discriminating operation for the counterfeit banknotes was properly completed. At the same time, the information that the aforementioned discriminating operation for the counterfeit banknotes was properly completed is transmitted to the POS system 30 via the transmitter 24. As a result, a desired information management can be carried out in the POS system 30.

Additionally, the information related to the denominations and quantities of all banknotes initially taken into the device 10, from the exterior, via the banknote taking-in port 12 is transmitted to the POS system 30 via the transmitter 24. Thus, this information (e.g., the information that the banknotes taken into the device 10 comprise one 100-dollar banknote and two 20-dollar banknotes) can also be managed in the POS system 30.

In this manner, a series of steps of the discriminating operation for the counterfeit banknotes are completed.

As described above, according to the counterfeit money discrimination support device 10 of this embodiment, only the banknotes judged to be of the denomination identical to the predetermined denomination of money set in advance, among those taken into the device 10 from the exterior, are ejected to the exterior as the specific banknotes, and simultaneously, the information related to the denomination and quantity of the specific banknotes to be ejected to the exterior is stored in the memory 23. Thereafter, the specific banknotes judged not to be counterfeit ones, by hand, among the specific banknotes ejected to the exterior, are taken again into the device 10. As a result, when the denomination and quantity of the specific banknotes taken again into the device 10 respectively correspond to the denomination and quantity stored in the memory 23, the discriminating operation for the counterfeit banknotes is judged to have been properly completed. With such a counterfeit money discrimination support device 10, since the banknotes of a specific denomination, such as large banknotes, can be automatically selected and only the so-selected banknotes can be discriminated by hand, the labor of the operator can be saved and the time required for the series of steps for the discriminating operation can be reduced, significantly, as compared with the case in which the operator must perform the discriminating operation, for all of the banknotes, for checking whether or not the banknotes are counterfeit ones. Additionally, the counterfeit money discrimination support device 10 can securely reduce the cost to be required for the entire device 10, as compared with the case of employing an automatic discriminating device, which is adapted to automatically discriminate whether the banknotes are counterfeit ones or not. Furthermore, with the counterfeit money discrimination support device 10, the operator can recognize, due to a tactile sense, such as hand feeling, whether or not the banknotes to be checked are the counterfeit ones, by directly touching the banknotes.

The counterfeit money discrimination support device according to this embodiment is not limited to the aspect as described above, and various modifications can be made thereto.

For example, in the counterfeit money discrimination support device 10 shown in FIG. 1, the banknotes to be discriminated are not limited to the dollar banknotes, but the euro banknotes, yen banknotes or any other banknotes of the other countries may be used as those to be discriminated. Specifically, the possibility of including counterfeit banknotes is also relatively high in the euro banknotes as is similar to the dollar banknotes. In particular, the 50-euro banknotes and/or 100-euro banknotes have been frequently counterfeited. As such, a desired discriminating operation can also be provided for checking the counterfeit euro banknotes, by setting such denominations as the predetermined denominations of money.

The money to be discriminated is not limited to the banknotes to be handled by the banknote handling part 11, it may be, for example, coins to be handled by the coin handling part 15. In such a case, the interface 29 of the control unit 20 is also connected with the coin taking-in port 16, coin storing box 17 and coin ejecting port 18, of the coin handling part 15. Consequently, only the coins judged to be of the denomination identical to the predetermined denomination of money, among the coins taken into the device from the exterior via the coin taking-in port 16, are ejected to the exterior as the specific coins. At this time, the information related to the denomination and quantity of the specific coins ejected to the exterior is stored in the memory 23. Thereafter, the specific coins judged not to be counterfeit ones, by hand, among the specific coins ejected to the exterior, are taken again into the device 10. As a result, when the denomination and quantity of the specific coins taken again into the device respectively correspond to the denomination and quantity stored in the memory 23, the discriminating operation for the counterfeit coins is judged to have been properly completed.

In addition, the alerting unit for notifying the operator that there is a need for performing the discrimination operation, by hand, for the banknotes, when the denomination judging section 22 judges that the banknotes taken into the device 10 via the banknote taking-in port 12 include some banknotes of the denomination identical to the predetermined denomination of money, is not limited to the aforementioned alerting buzzer 25 adapted to generate an alerting sound for appealing to the ear of the operator. Alternatively, the alerting unit may be ones for appealing to the eyes of the operator, such as by displaying by means of a touch panel or the like. Also, the alerting unit may be configured to send the information for notifying that there is a need for performing the discriminating operation for the banknotes, by hand, to the POS system 30.

Similarly, the alarming unit for providing an alarm to the operator when some failure occurs in the counterfeit money discrimination support device 10 is not limited to the buzzer 26 for failure, which is designed to appeal the ear of the operator by generating an alarming sound. Instead, the alarming unit may be ones for appealing to the eyes of the operator, such as by displaying by means of a touch panel or the like. In this case, it is preferred that the configurations of the alerting unit and alarming unit are completely different from each other, such that the alerting unit employs one for appealing to the ear of the operator while the alarming unit employs one for appealing to the eyes of the operator, or vice versa.

Again, the end of discriminating operation annunciating unit for informing the operator that the discriminating operation for the counterfeit banknotes was properly completed is not limited to the end of discriminating operation annunciating buzzer 27 designed to appeal the ear of the operator by generating an annunciating sound. Namely, as previously described, the end of discriminating operation annunciating unit may also be the ones for appealing to the eyes, such as a touch-panel display.

The invention claimed is:

1. A counterfeit money discrimination support device for supporting a discriminating operation, by hand, for checking whether money is counterfeit money or not, the counterfeit money discrimination support device comprising:

a denomination setting unit for setting, in advance, a denomination of money to be discriminated, as a predetermined denomination of money;

a money taking-in unit for taking money into the device from the exterior;

a denomination judging unit for judging whether or not the denomination of the money taken into the device by the money taking-in unit is identical to the predetermined denomination of money set in advance by the denomination setting unit;

a money ejecting unit for ejecting the money judged to be of the denomination identical to the predetermined denomination of money by the denomination judging unit, to the exterior, as specific money; and a memory for storing, therein, the denomination and quantity of the specific money ejected by the money ejecting unit, wherein the specific money discriminated as being not counterfeit money, by hand, among the specific money ejected to the exterior by the money ejecting unit is taken again into the device by the money taking-in unit, and wherein when the denomination and quantity of the specific money taken again into the device correspond respectively to the denomination and quantity of money stored in the memory, the discriminating operation for the counterfeit money is judged to have been properly completed.

2. The counterfeit money discrimination support device according to claim 1, further comprising an end of discriminating operation annunciating unit for informing an operator that the discriminating operation for the counterfeit money was properly completed, when the discriminating operation for the counterfeit money is judged to have been properly completed.

3. The counterfeit money discrimination support device according to claim 1, wherein the counterfeit money discrimination support device is connected with an external point-of-sale system, and wherein the counterfeit money discrimination support device further comprises a transmitting unit for transmitting information that the discriminating operation for the counterfeit money was properly completed, to the point-of-sale system, when the discriminating operation for the counterfeit money is judged to have been properly completed.

4. The counterfeit money discrimination support device according to claim 3, wherein the transmitting unit also transmits information related to the denomination and quantity of money taken first into the device from the exterior by the money taking-in unit, to the point-of-sale system, when the discriminating operation for the counterfeit money is judged to have been properly completed.

5. The counterfeit money discrimination support device according to claim 1, further comprising an alerting unit for notifying the operator that there is a need for performing the discriminating operation, by hand, when the denomination judging unit judges that the money to be taken into the device by the money taking-in unit includes money of the denomination identical to the predetermined denomination of money.

6. The counterfeit money discrimination support device according to claim 5, further comprising an alarming unit for alarming the operator when some trouble occurs in the counterfeit money discrimination support device, wherein the alerting unit and the alarming unit are respectively configured to transmit individual information to the operator by ways different from each other.

* * * * *